US008726992B2

(12) United States Patent
Freyer

(10) Patent No.: US 8,726,992 B2
(45) **Date of Patent: *May 20, 2014**

(54) METHOD AND DEVICE FOR FILLING A VOID INCOMPLETELY FILLED BY A CAST MATERIAL

(75) Inventor: Rune Freyer, Stavanger (NO)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/079,727

(22) Filed: Apr. 4, 2011

(65) Prior Publication Data

US 2011/0180264 A1 Jul. 28, 2011

Related U.S. Application Data

(63) Continuation of application No. 10/598,559, filed as application No. PCT/NO2005/000456 on Dec. 12, 2005, now Pat. No. 7,946,351.

(51) Int. Cl.
*E21B 33/13* (2006.01)
*E21B 33/12* (2006.01)

(52) U.S. Cl.
USPC ..... 166/285; 166/179

(58) Field of Classification Search
None
See application file for complete search history.

(56) References Cited

U.S. PATENT DOCUMENTS

| | | | | |
|---|---|---|---|---|
| 2,230,626 A | | 2/1941 | Miller | |
| 2,849,070 A | | 8/1958 | Maly | |
| 3,099,318 A | | 7/1963 | Miller | |
| 3,306,870 A | | 2/1967 | Eilers et al. | |
| 3,385,367 A | | 5/1968 | Kollsman | |
| 3,387,656 A | | 6/1968 | Guest et al. | |
| 3,387,661 A | | 6/1968 | Evans et al. | |
| 3,486,758 A | | 12/1969 | Alexander, Jr. | |
| 3,554,287 A | | 1/1971 | Eilers | |
| 3,611,733 A | | 10/1971 | Eilers et al. | |
| 3,918,523 A | | 11/1975 | Stuber | |
| 4,137,970 A | * | 2/1979 | Laflin et al. | 166/292 |
| 4,714,117 A | | 12/1987 | Dech | |
| 4,716,965 A | | 1/1988 | Bol et al. | |
| 4,886,550 A | | 12/1989 | Alexander | |
| 4,919,989 A | | 4/1990 | Colangelo | |
| 4,936,386 A | | 6/1990 | Colangelo | |
| 5,048,605 A | | 9/1991 | Toon | |
| 5,127,473 A | | 7/1992 | Harris et al. | |
| 5,188,176 A | | 2/1993 | Carpenter | |

(Continued)

FOREIGN PATENT DOCUMENTS

| | | |
|---|---|---|
| EP | 0197609 A2 | 10/1986 |
| EP | 287735 A2 | 10/1988 |

(Continued)

OTHER PUBLICATIONS

English language abstract for JP 9151686.

(Continued)

*Primary Examiner* — Angela M. DiTrani
(74) *Attorney, Agent, or Firm* — Smith IP Services, P.C.

(57) ABSTRACT

A method and a device for sealing a void incompletely filled with a cast material, in which an expandable material is placed in the void which is to be filled with a cast material, the expandable material expanding, when expanding after the cast material has cured, into spaces which are not filled with cast material.

25 Claims, 3 Drawing Sheets

(56) References Cited

U.S. PATENT DOCUMENTS

| | | | | |
|---|---|---|---|---|
| 5,195,583 | A | 3/1993 | Toon | |
| 5,211,238 | A | 5/1993 | Carpenter | |
| 5,402,849 | A | 4/1995 | Jennings | |
| 5,476,142 | A | 12/1995 | Kajita | |
| 5,657,822 | A | 8/1997 | Toon | |
| 5,810,085 | A | 9/1998 | James | |
| 5,942,031 | A | 8/1999 | Cheung | |
| 6,007,615 | A | 12/1999 | Kato et al. | |
| 6,102,119 | A | 8/2000 | Raines | |
| H1932 | H | 1/2001 | Heathman et al. | |
| 6,848,505 | B2 | 2/2005 | Richard et al. | |
| 6,983,799 | B2 * | 1/2006 | Reddy et al. | 166/291 |
| 7,059,415 | B2 | 6/2006 | Bosma et al. | |
| 7,066,259 | B2 | 6/2006 | Duggan et al. | |
| 7,066,283 | B2 | 6/2006 | Livingstone | |
| 7,303,023 | B2 * | 12/2007 | Harrall et al. | 166/384 |
| 7,380,594 | B2 | 6/2008 | Benzie et al. | |
| 7,597,152 | B2 * | 10/2009 | Wood et al. | 166/387 |
| 7,665,537 | B2 | 2/2010 | Patel et al. | |
| 7,946,351 | B2 * | 5/2011 | Freyer | 166/387 |
| 2003/0075342 | A1 | 4/2003 | Gunnarsson | |
| 2004/0020662 | A1 | 2/2004 | Freyer | |
| 2004/0194971 | A1 | 10/2004 | Thomson | |
| 2005/0072579 | A1 | 4/2005 | Gambier | |
| 2007/0227734 | A1 | 10/2007 | Freyer | |

FOREIGN PATENT DOCUMENTS

| | | | | |
|---|---|---|---|---|
| EP | 1793078 | * | 12/2005 | E21B 17/10 |
| GB | 2396635 | A | 6/2004 | |
| GB | 2406593 | A | 4/2005 | |
| JP | 9151686 | A | 6/1997 | |
| JP | 9317369 | A | 12/1997 | |
| SE | 522748 | C2 | 3/2004 | |
| WO | 9945233 | A1 | 9/1999 | |
| WO | 0180650 | A2 | 11/2001 | |
| WO | 0220941 | A1 | 3/2002 | |
| WO | 02059452 | A1 | 8/2002 | |
| WO | 03008756 | A1 | 1/2003 | |
| WO | 03056125 | A | 7/2003 | |
| WO | 04001183 | A1 | 12/2003 | |
| WO | 2004067906 | A1 | 8/2004 | |
| WO | 2004074621 | A2 | 9/2004 | |
| WO | 2004101951 | A1 | 11/2004 | |
| WO | 2004101952 | A2 | 11/2004 | |
| WO | 20050116394 | A1 | 12/2005 | |
| WO | 2006065144 | A1 | 6/2006 | |

OTHER PUBLICATIONS

English language abstract for JP 9317369.

NO International Search Report issued Aug. 1, 2005, for Norwegian International Application No. 20045478, 1 page.

International Search Report issued Mar. 3, 2006, for International Application No. PCT/NO2005/000456, 2 pages.

Examiner's first report issued Mar. 16, 2009, by IP Australia for Australian Patent Application Serial No. 2005317308, 2 pages.

GCC Search Report issued Jun. 3, 2009, for GCC Patent Application Serial No. GCC/P/2005/5517, 6 pages.

MX Official Action issued Jun. 8, 2009, for MX Patent Application Serial No. MX/a/2007/007284, 4 pages.

CN Office Action issued Dec. 25, 2009, for Chinese Patent Application Serial No. 200580043235.8, 6 pages.

Search Opinion issued Jul. 28, 2010, for EP Patent Application No. 05817486.3, 2 pages.

Search Report issued Jul. 28, 2010, for EP Patent Application No. 05817486.3, 2 pages.

Office Action issued Oct. 18, 2010, for MX Patent Application No. MX/a/2007/007284, 3 pages.

European Patent Office Notification regarding EP1825099 A0, 1 page.

Office Action issued Apr. 29, 2008, for U.S. Appl. No. 10/598,559, 32 pages.

Office Action issued Oct. 23, 2008, for U.S. Appl. No. 10/598,559, 14 pages.

Office Action issued Nov. 10, 2009, for U.S. Appl. No. 10/598,559, 17 pages.

Office Action issued Jun. 18, 2010, for U.S. Appl. No. 10/598,559, 12 pages.

Search Report issued Nov. 26, 2011 for GCC Patent Application No. GCC/P/2005/5517, 2 pages.

Search Report issued Nov. 28, 2011 for GCC Patent Application No. GCC/P/2005/5517, 5 pages.

Notice of Opposition dated Aug. 22, 2012 issued for European Patent No. EP1825099, 6 pages.

Grounds of Opposition dated Aug. 22, 2012 to EPC for European Patent No. EP1825099 by Marks&Clerk LLP., 27 pages.

Communication of Notice of Opposition dated Aug. 31, 2012 for European Patent No. EP1825099, 1 page.

Bonett, Art et al., "Getting to the Root of Gas Migration" Oilfield Review, Spring 1996, 14 pages.

Response issued Apr. 12, 2013 for European Patent Application No. 05817486.3, 45 pages.

* cited by examiner

I–I

II–II

METHOD AND DEVICE FOR FILLING A VOID INCOMPLETELY FILLED BY A CAST MATERIAL

The present application is a continuation of U.S. application Ser. No. 10/598,559 filed on Sep. 5, 2006, now U.S. Pat. No. 7,946,351, and which is a U.S. national stage commencement under 35 USC 371 of prior International Application No. PCT/NO2005/000456, filed Dec. 12, 2005 and published as International Publication No. WO 2006/065144, which claims the benefit of the filing date of Norway Patent Application No. 20045478, filed Dec. 16, 2004, now Norwegian Patent No. 322718. The entire disclosures of these prior applications are incorporated herein by this reference.

This invention relates to a method for sealing a void incompletely filled with a cast material. More particularly, the method comprises the placing of an expandable material in the void which is to be filled with cast material, the expandable material expanding, when expanding, after the cast material has cured, into spaces which are not filled with cast material. The method is particularly suitable for sealing openings in an annulus round a cast-in casing as it is known from the recovery of petroleum. The invention also comprises a device for practicing the invention.

When cementing the annulus between a casing and the formation wall in a borehole, especially when approximately horizontal wells are involved, it can be very difficult or impossible to achieve complete filling of the annulus with a cast material.

The reason for this condition is essentially that a fluid present on the underside of the casing is difficult to drain completely. This fluid may include drilling fluid.

Fluid present in said annulus during the curing of the cast material, and in particular fluid present in the lower portion of the annulus, could form a channel along the borehole, which may extend so far that it connects different zones of the borehole.

It is obvious that channels of this kind are undesirable as an uncontrollable fluid transport may occur in the channel. For example, formation water from a zone may flow into a nearby petroleum-producing zone.

It is known to use an expandable material to shut off an annulus. Thus, Norwegian patent 312478 discloses a packer which is made of a swellable material. After the packer has been placed at a desired location, the material of the packer absorbs a fluid and thereby swells until it seals the annulus.

The invention has as its object to remedy or reduce at least one of the drawbacks of the prior art.

The object is realized in accordance with the invention through the features specified in the description below and in the following Claims.

Sealing of a void which is incompletely filled with a cast material, is realized according to the invention by placing an expandable material in the void which is to be filled with cast material. The expandable material then expands into spaces which are not filled with cast material after the cast material has cured, typically by displacing a fluid.

When, for example, a casing is to be cemented in a borehole, at least one sleeve-shaped plug is placed so that it encircles the casing, before the casing is run into the borehole.

When the casing has been run to its predetermined position in the borehole, the annulus encircling the casing is filled with drilling fluid, the expandable material attempting, to a certain degree, to centralize the casing in the borehole.

When a cast material, normally in the form of concrete, then flows into the annulus, the fluid present in the annulus is is essentially displaced as the volume fills with concrete.

It has turned out to be difficult, however, to drain all the fluid away from the annulus, and some fluid accumulates at the bottom of the annulus. After casting, the sleeve-shaped plug of expandable material is partly in this fluid and partly embedded in the cast material.

The expandable material will expand, for example due to swelling on contact with the fluid or by diffusion of the fluid into openings in the expandable material. Adjacent fluid is displaced by the expandable material, which thereby has the effect that, for example, a fluid channel in the lower portion of an annulus is shut off.

The expandable material may be formed, for example, by a swellable material or by a foam-like diffusible material which is compressed before being placed in the borehole, cavities in the material filling up with fluid with time, whereby the material expands. The expandable material may be designed to expand on contact with, for example, water, oil, gas or other suitable materials.

A swellable material may be selected, for example, from the group including an elastic polymer such ad EPDM rubber, styrene/butadiene, natural rubber, ethylene/propylene monomer rubber, styrene/propylene/diene monomer rubber, ethylene/vinyl acetate rubber, hydrogenated acrylonitrile/butadiene rubber, acrylonitrile/butadiene rubber, isoprene rubber, chloroprene rubber or polynorbornene. The swellable material may further include mixtures of the mentioned materials, possibly with the addition of other dissolved or mixed-in materials, such as cellulose fibre, as it is described in U.S. Pat. No. 4,240,800. Further alternatives may be a rubber in a mechanical mixture with polyvinyl chloride, methyl methacrylate, acrylonitrile, ethyl acetate or other polymers which will expand on contact with oil.

A diffusible material can be selected from the group including nitrile rubber. As mentioned above, the diffusible material is made of an elastic material with a considerable portion of closed cavities, the material allowing the diffusion of a fluid through the material into the cavities.

The expandable materials may be provided with one or more reinforcements, for example in the form of a fibre cloth.

In what follows is described a non-limiting example of a preferred method and embodiment which are visualized in the accompanying schematic drawings, in which.

Figure 1:
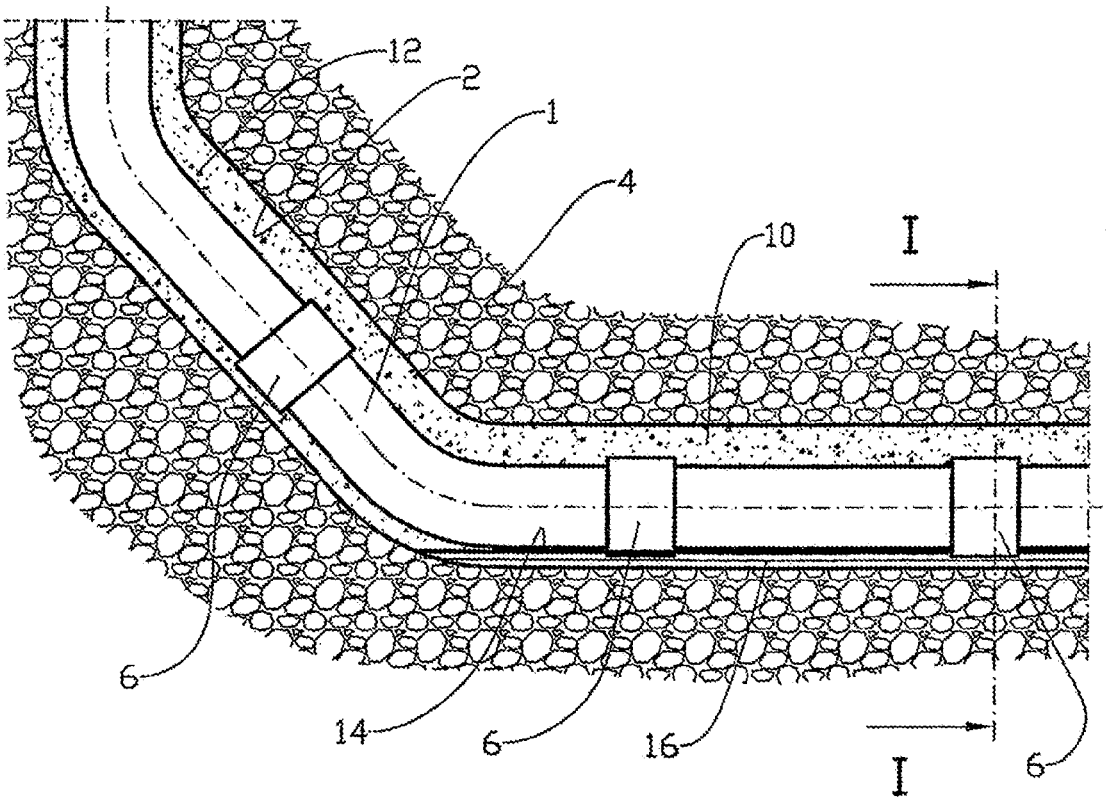
FIG. 1 shows a casing which is provided with sleeves of an expandable material, and which is placed in an approximately horizontal borehole in the ground, cast material having been filled into the annulus between the casing and the borehole wall.

In the drawings the reference numeral 1 identifies a casing which is located in a borehole 2 of a formation 4.

The casing 1 is encircled by several sleeves 6 made of an expandable material.

The sleeves 6 are fitted to the casing 1 before the casing is run into the borehole 2, and the sleeves 6 thereby help the casing 1 not to be laid down completely on the bottom of the borehole 2.

Most advantageously, the sleeve 6 is provided with an externally penetratable, preferably durable cloth material 8. This material may also contain reinforcement in the form of metal bodies or synthetic fibre. The penetratable cloth material 8 inhibits the expandability of the sleeve 6 only to an insignificant degree.

After the casing 1 has been placed in the borehole 2, cast material 10, here concrete, is filled into a void 12 in the form of an annulus between the casing 1 and the borehole 2, see FIG. 1.

Figure 3:
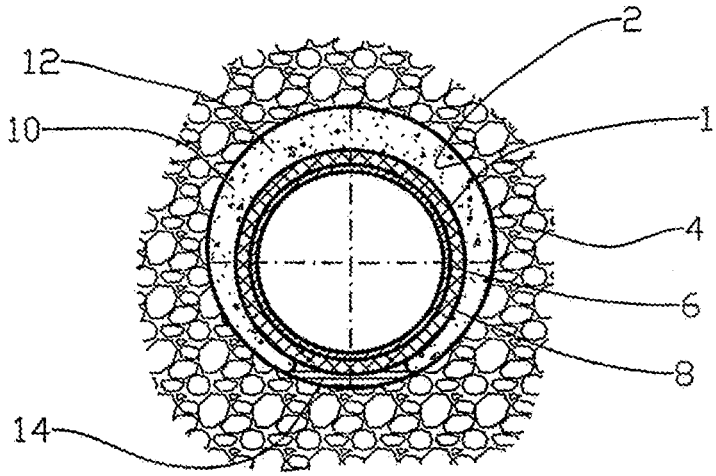
FIG. 3 shows a section I-I of FIG. 1.

As appears from FIGS. 1 and 3, the annulus 12 is not completely filled with cast material 10, as some drilling fluid 14 is present in the lower portion of the annulus 12.

This drilling fluid 14 which has not been displaced by the cast material 10, has the effect that a flow-permitting cannel 16 is formed along the borehole 2.

Figure 2:
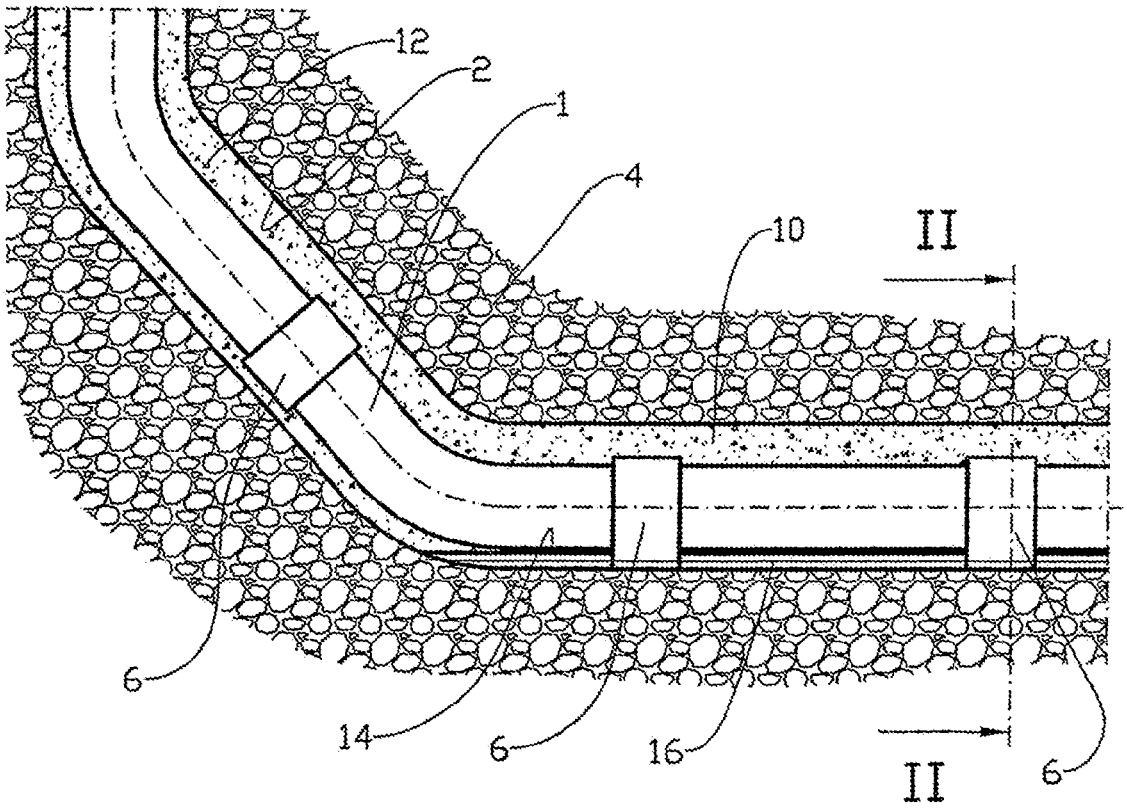
FIG. 2 shows the same as FIG. 1 after some time has passed, the expandable material having sealed an opening in the cast material.
Figure 4:
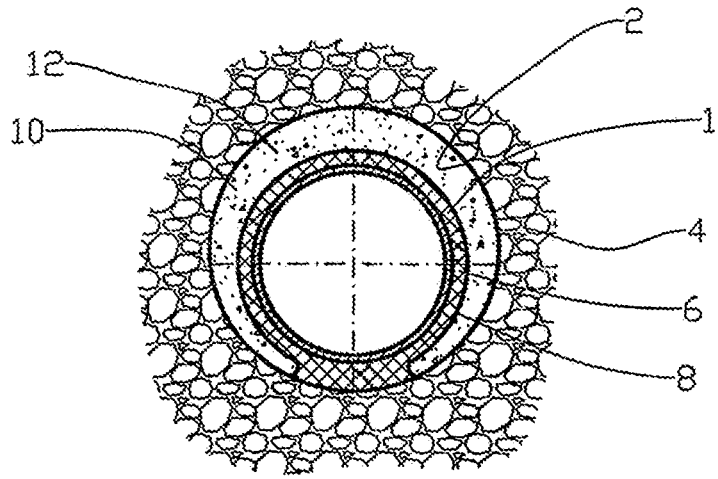
FIG. 4 shows a section II-II of FIG. 2.

After some time the expandable material of the sleeve 6 has expanded, through the influence of the drilling fluid 14, for example, and displaced the drilling fluid 14 present between the sleeve 6 and the borehole 2, see FIGS. 2 and 4. The expandable material of the sleeve 6 now abuts the wall of the borehole 2, thereby sealing the longitudinal channel 16 to fluid flow.

The invention claimed is:

1. A system for use with a well, comprising:

an expandable material which expands into a space in an annulus following cementing of the annulus with a castable material, wherein the expandable material expands in response to contact with a fluid which filled the space prior to the cementing of the annulus and was not displaced from the space by the castable material during the cementing of the annulus.

2. The well system of claim 1, wherein the expandable material expands from a retracted state to an expanded state in response to contact with the fluid.

3. The well system of claim 1, wherein the space is at least partially bounded by the castable material.

4. The well system of claim 1, wherein the castable material comprises concrete.

5. The well system of claim 1, wherein the space is at least partially bounded by a borehole wall.

6. The well system of claim 1, wherein the expandable material is incorporated into an annular element disposed on a tubular structure.

7. The well system of claim 1, wherein the expandable material comprises a swellable material.

8. The well system of claim 7, wherein the swellable material swells in response to contact with water.

9. The well system of claim 7, wherein the swellable material swells in response to contact with oil.

10. The well system of claim 7, wherein the swellable material swells in response to contact with gas.

11. A method of sealing a space in an annulus of a well, the method comprising:

expanding an expandable material into the space following cementing of the annulus with a castable material, wherein the expandable material expands in response to contact with a fluid which filled the space prior to the cementing of the annulus and was not displaced from the space by the castable material during the cementing of the annulus.

12. The method of claim 11, wherein the expandable material expands from a retracted state to an expanded state in response to contact with the fluid.

13. The method of claim 11, wherein the space is at least partially bounded by the castable material.

14. The method of claim 11, further comprising positioning the expandable material in the annulus prior to flowing the castable material into the annulus.

15. The method of claim 11, further comprising positioning the expandable material on a tubular structure.

16. The method of claim 11, wherein the expandable material comprises a swellable material.

17. The method of claim 16, wherein the expanding step further comprises the swellable material swelling in response to contact with water.

18. The method of claim 16, wherein the expanding step further comprises the swellable material swelling in response to contact with oil.

19. The method of claim 16, wherein the expanding step further comprises the swellable material swelling in response to contact with gas.

20. The method of claim 11, wherein the space is at least partially bounded by a borehole wall.

21. A method for sealing a space in a borehole, characterized by the steps of:

disposing on a tubular element at least one annular element comprising an expandable material which extends from a retracted state to an expanded state in response to contact with a fluid;

then eccentrically positioning the tubular element in the borehole;

then flowing a castable material into a volume defined by a wall of the borehole and outer surfaces of the tubular element and the annular element, the castable material being disposed radially between and in contact with the borehole wall and a portion of the annular element, and the fluid filling the space prior to the flowing of the castable material and not being displaced from the space by the castable material during the flowing of the castable material; and then extending the expandable material into the space.

22. The method of claim 21, wherein the disposing step comprises disposing a plurality of the annular elements at spaced intervals along a length of the tubular element.

23. The method of claim 21, wherein the expandable material comprises a swellable material.

24. The method of claim 21, wherein the expandable material extends into the space after the castable material has hardened.

25. The method of claim 21, wherein the space comprises a longitudinal channel defined by at least the castable material, the tubular element, and the borehole wall.

* * * * *